US005709147A

United States Patent [19]

Uera et al.

[11] Patent Number: 5,709,147

[45] Date of Patent: Jan. 20, 1998

[54] INK-FURNISHING APPARATUS WITH DEHYDRATION

[75] Inventors: Yoshinori Uera; Taiichi Ichizawa; Kohji Yoshizawa, all of Kawasaki; Takashi Iijima, Yokosuka, all of Japan

[73] Assignee: Kabushiki Kaisha Tokyo Kikai Seisakusho, Tokyo, Japan

[21] Appl. No.: 572,056

[22] Filed: Dec. 14, 1995

[30] Foreign Application Priority Data

Aug. 28, 1995 [JP] Japan ..... 7-243716

[51] Int. Cl.[6] ..... B41F 31/02

[52] U.S. Cl. ..... 101/350; 101/450.1

[58] Field of Search ..... 101/349, 350, 101/364, 450.1, 451

[56] References Cited

U.S. PATENT DOCUMENTS

| | | | |
|---|---|---|---|
| 4,787,314 | 11/1988 | Harada et al. | 101/350 |
| 4,790,243 | 12/1988 | Grosshauser | 101/350 |
| 5,012,737 | 5/1991 | Makino et al. | 101/350 |
| 5,044,274 | 9/1991 | Gaunt | 101/451 |
| 5,113,761 | 5/1992 | Okamura | 101/350 |
| 5,205,216 | 4/1993 | Okamura et al. | 101/350 |
| 5,357,864 | 10/1994 | Ohta et al. | 101/350 |

FOREIGN PATENT DOCUMENTS

| | | | |
|---|---|---|---|
| 61-98537 | 5/1986 | Japan . | |
| 163857 | 7/1986 | Japan | 101/350 |
| 62-62761 | 3/1987 | Japan . | |
| 62-109940 | 7/1987 | Japan . | |
| 62-160241 | 7/1987 | Japan . | |
| 7-45244 | 5/1995 | Japan . | |

*Primary Examiner*—Stephen R. Funk
*Attorney, Agent, or Firm*—Trexler, Bushnell, Giangiorgi & Blackstone, Ltd.

[57] ABSTRACT

Disclosed is an ink furnishing apparatus in a lithographic printing press with a keyless system which performs printing by furnishing a relatively high viscous ink and dampening water to printing plates on a plate cylinder. A first shearing force is exerted on the ink upon drawing out the ink deposited on a peripheral surface of a fountain roller through a first gap between an ink fountain and the peripheral surface of the fountain roller by rotation of the fountain roller, and a second shearing force is exerted on the ink due to a difference of peripheral speeds of the fountain roller and a first intermediate roller upon transition of the ink from the peripheral surface of the fountain roller to the peripheral surface of the first intermediate roller across a second gap between the peripheral surface of the fountain roller and the peripheral surface of the first intermediate roller, thus, water is separated from the ink.

4 Claims, 12 Drawing Sheets

INK-FURNISHING APPARATUS WITH DEHYDRATION

BACKGROUND OF THE INVENTION

The present invention relates to an ink furnishing apparatus for a lithographic printing press which performs printing by furnishing a relatively high viscous ink and dampening water on the surface of a printing plate on a plate cylinder. More specifically, the invention relates to an ink-furnishing apparatus with a dehydrating function which can separate excessive dampening water penetrating into an ink in an ink fountain in a route for furnishing an ink through the surface of the printing plates on the plate cylinder from an apparatus for supplying dampening water in the ink furnishing apparatus within a keyless system, in which adjustment of an ink furnishing amount is unnecessary, and namely, the ink is furnished on the overall surface of the printing plate in substantially uniform thickness by employing a metering roller.

DESCRIPTION OF THE RELATED ART

In the conventional lithographic priming press which furnishes dampening water and an ink, it is typical to uniformly supply a substantially constant amount of dampening water to the surface of a printing plate irrespective of proportion and positions of the image printing portion and the non-image printing portion. Accordingly, it is possible that the dampening water which is furnished to the non-image printing portion becomes extra to be admixed with an ink on the peripheral surface of a form roller to penetrate into an ink furnishing apparatus. Then, in a keyless ink furnishing apparatus, the dampening water reaching the peripheral surface of a metering roller forming the ink furnishing apparatus is scraped off together with the ink by a doctor means contacting the peripheral surface of the metering roller and the dampening water is recirculated to the most upstream of the ink furnishing. According to progress of the printing operation, the amount of water contained in the most upstream of the ink furnishing is increased. Such water can lower the printing density on the surface of a printing medium, or can lower the printing quality and/or cause failure of the ink furnishing, such as roller stripping and so forth.

Therefore, various attempts have been made for removing water from the ink. The present invention is generally directed to removing the water from the ink by applying a shearing force to the ink. Background art for such technologies have been disclosed in Japanese Unexamined Patent Publication (Kokai) No. Showa 61-98537, Japanese Unexamined Patent Publication No. Showa 62-62761, Japanese Unexamined Patent Publication No. Showa 62-160241 and Japanese Unexamined Utility Model Publication No. Showa 62-109940. Japanese Unexamined Patent Publication No. Showa 61-98537 discloses an ink furnishing apparatus including a water separating apparatus. The water separating apparatus includes two rollers rotating to displace the peripheral surfaces in mutually the same direction at different peripheral speeds at the position where the peripheral surfaces thereof are contacting each other, a film thickness control blade located adjacent one of the rollers, a separated ink scraping blade contacting the other roller and a separated water receptacle container provided under the two rollers. With the construction set forth above, the ink scraped off the ink furnishing apparatus is received by the film thickness control blade and transferred to the contact position of the two rollers by a peripheral surface of one of the rollers.

Then, because the peripheral speeds of two rollers are unequal, a shearing force is applied to the ink to separate the dampening water from the ink. The separated water is then collected by the water receptacle container and is returned to the ink tank, Japanese Unexamined Patent Publication No. Showa 6262761, Japanese Unexamined Patent Publication No. Showa 62-160241 and Japanese Unexamined Utility Model Publication No. Showa 62-109940 each disclose an ink furnishing apparatus incorporating a moisture separating mechanism. The ink furnishing apparatus disclosed in these publications comprise an ink storage tank provided at a lower portion, a piping mechanism including an ink pump for sucking the ink in the ink tank and feeding the same under pressure, an ink ejection nozzle connected to the downstream end of the piping mechanism, an ink furnishing roller group, in which rollers from an ink fountain roller having the peripheral surface positioned in the vicinity of an ejection opening of the ink ejection nozzle in opposition thereto, to a form roller contacting the peripheral surface thereof onto the surface of the printing plate of the plate cylinder, are associated for rotation to displace the peripheral surfaces thereof in the same direction at respective contacting positions, and an ink scraping blade for scraping off the excessive ink from the peripheral surface of the roller immediately upstream of the form roller. With the construction set forth above, the ink in the ink tank is sucked by the ink pump and fed under pressure to the ink ejection nozzle for ejecting the ink onto the ink fountain roller. Then, the ink on the ink fountain roller is furnished to the printing plate on the plate cylinder via the ink supply roller group. The excessive ink is scraped off by the ink scraping blade immediately upstream of the form roller.

The ink furnishing apparatus disclosed in Japanese Unexamined Patent Publication No. Showa 62-62761 is provided with, in addition to the mechanism set forth above, a driving device for driving the ink fountain roller and a transfer roller contacting on the peripheral surface of the ink fountain roller at an immediately downstream side of the ink fountain roller at mutually different peripheral speeds, and a separated water tank located below the ink fountain roller and the transfer roller. The ink fountain roller, the transfer roller, the driving device and the separated water tank form a moisture separating mechanism. With such construction, the ink reaching the contacting position between the ink fountain roller and the transfer roller is applied a shearing force by relative peripheral speed difference between thereto because of the difference in speeds at which the ink fountain roller and the transfer roller rotate. By applying a shearing force, the water admixed with the ink is separated and collected in the separated water tank.

The ink furnishing apparatus disclosed in Japanese Unexamined Patent Publication No. Showa 62-160241 includes a water separation roller which is located immediately upstream of an ink fountain roller and contacts with the peripheral surface of the ink fountain roller to displace the peripheral surface in the same direction to that of the peripheral surface of the ink fountain roller but at different peripheral speeds, an ink ejection nozzle is provided in the vicinity of the peripheral surface of the water separation roller, and a separated water tank below the ink fountain roller and the water separation roller, in addition to the basic mechanism set forth above. The ink fountain roller, the water separation roller and the separated water tank form the water separation mechanism. With the construction set forth above, the ink reaching the contact position between the ink fountain roller and the water separation roller is exerted thereto a shearing force due to relative difference of the peripheral speeds between the water separation roller and the ink fountain roller. As a result, the water admixed in the ink separates and is collected in the separated water tank.

The ink furnishing apparatus disclosed in Japanese Unexamined Utility Model Publication No. Showa 62-109940, is provided with a water separation roller acting as a rider roller which contacts the peripheral surface of the ink fountain roller at a position on the peripheral surface of the ink fountain roller downstream relative to the contact position between the ink fountain roller and a transfer roller immediately downstream from the ink fountain roller, a driving mechanism which drives the water separation roller at a peripheral speed different from the ink transferring roller, and a separated water tank located below the ink transfer roller and the water separation roller, in addition to the basic mechanism. The ink transfer roller, the water separation roller, the driving mechanism and the separated water tank form the water separation mechanism. In the construction set forth above, the ink reaching the contact portion between the ink transfer roller by rotation of the ink transfer roller, is exerted a shearing force thereto due to the relative difference of the peripheral speeds between the water separation roller and the ink fountain roller. Consequently, the water admixed in the ink is separated and collected in the separated water tank.

A keyless ink furnishing apparatus adapted for relatively high viscous ink is disclosed in commonly owned Japanese Examined Patent Publication (Kokoku) No. 7-45244. The keyless ink furnishing apparatus includes an ink fountain defined by a tilted plate and the peripheral surface of a fountain roller, a form roller contacting the peripheral surface with the printing plates on surface of the plate cylinder, an inking roller group transferring ink from the fountain roller to the form roller, in which respective of adjacent rollers are contacted or opposed with a small gap for cooperation, a doctor blade for scraping off the ink from the peripheral surface of the roller located immediately upstream of the form roller, and an ink receptacle extending from a lower portion of the ink fountain to a lower portion of the roller located immediately downstream of the fountain roller. The ink in the ink fountain deposited on the peripheral surface is drawn downwardly through the gap between the peripheral surface of the fountain roller and the lower end of the tilted plate by rotation of the fountain roller. The ink carried by the peripheral surface of the fountain roller reaches the downstream side roller which rotates to displace the peripheral surface thereof in the opposite direction to the fountain roller. Then, the ink is transferred to this downstream side roller, and is further transferred sequentially through rollers in a similar manner to reach the roller located immediately upstream of the form roller. Then, the excess ink is scraped off the peripheral surface of the roller immediately upstream of the form roller. Thus, a substantially uniform amount of ink is supplied to the overall width of the form roller and then is supplied to the printing plate surface. The excessive ink scraped off by the doctor blade from the peripheral surface of the roller upstream from the form roller is collected in the ink fountain. While the above offer certain advantages, there is still room for improvement.

For instance, the keyless ink furnishing apparatus adapted for relatively high viscous ink, as disclosed in the commonly owned Japanese Examined Patent Publication No. Heisei 7-45244 does not teach removing the water admixed with ink by separating the same from the ink. The reason is that, upon drawing out the ink through the gap defined between the peripheral surface of the fountain roller and the lower end of the tilted plate, even when a shearing force is exerted on the ink to situate the ink and the water in a condition to be easily separated, splashing of the ink can be caused upon transfer of the ink from the fountain roller to the immediately downstream side roller without causing the water to separate. Therefore, the disclosed apparatus cannot prevent the water content in the ink from increasing during the printing operation. Furthermore, splashing increases as a result of increasing the relative peripheral speed between the fountain roller and the immediately downstream roller.

On the other hand, in the case of the technologies disclosed in the above-identified Japanese Unexamined Patent Publication (Kokai) No. Showa 61-98537, Japanese Unexamined Patent Publication No. Showa 62-62761, Japanese Unexamined Patent Publication No. Showa 62160241 and Japanese Unexamined Utility Model Publication No. Showa 62-109940, in which the shearing force is exerted on the ink to remove the water from the ink, the following problems are experienced.

Japanese Unexamined Patent Publication No. 61-98537 has the water separating apparatus independent of the ink furnishing apparatus and located in the vicinity thereof. Accordingly, it is required to provide installation space. For this reason, the diameters of the two rollers exerting the shearing force must be small to avoid great deflection and unstable rotation. Thus, process capacity is small and water separation efficiency becomes low. Furthermore, since two rollers are contacting, the ink layer passing therethrough is thin making the amount of water separated from the ink by the effect of shearing small. Therefore, before the water droplet formed by aggregating of the small amount of water drops into the separated water tank, it can be transferred through the contacting portion of two rollers. Thus, the water is scraped off together with the ink by the ink scraping blade and is returned to the ink tank together with the ink. Therefore, during printing operation, particularly in high speed printing operation, effective water separation can not be achieved. Additionally since the water separating apparatus is provided in the vicinity of the ink furnishing apparatus, workability in maintenance for not only the water separation device, but also in nip adjustment of the roller of the ink furnishing apparatus, exchanging of the roller and/or blade and so forth. Furthermore, since the water separating apparatus and the ink furnishing apparatus are independent with respect to each other, not only production cost but also running cost becomes higher because separate consumable goods are required, such as rollers, blades and so forth.

Japanese Unexamined Patent Publication No. Showa 62-62761, Japanese unexamined Patent Publication No. Showa 62-16041 and Japanese Unexamined Utility Model Publication No. Showa 62-109940, disclose attempts to avoid problems caused by independently providing the water separating apparatus by incorporating the water separating mechanism into the ink furnishing apparatus. However, all of the ink furnishing apparatus disclosed in these three publications employ a construction for returning the ink scraped from the peripheral surface of the ink furnishing roller group to the ink tank, sucking and feeding under pressure through the piping mechanism including the ink pump, supplying the ink to the ink ejection nozzle to supply the most upstream roller. Accordingly, the ink supplied to the most upstream roller is satisfactorily stirred through suction and feeding under pressure by the piping mechanism including the ink pump. By stirring the water admixed in the ink, the water is maintained in the ink in the highly stable state. Even when a shearing force is exerted by feeding the water admixing ink to the water separating mechanism in the ink furnishing roller group, high water separation efficiency cannot be attained. Furthermore, since two rollers forming the water separating mechanism are contacting each other, the ink layer passing therethrough is thin thus making the amount of water to be separated from the ink by the effect of shearing small. Therefore, before the water droplet formed by aggregating of the small amount of water drops into the separated water tank, it can be transferred through the contacting portion of two rollers. Thus, a large proportion of the water admixed in the ink is supplied to downstream together with the ink through the roller located downstream of the two rollers forming the water separating mechanism. Therefore, even with the technologies disclosed in the above-identified three publications, the water cannot be separated effectively during a printing operation, particularly during high speed printing operation

SUMMARY OF THE INVENTION

It is an object of the present invention to solve the problems in the prior art set forth above, and to provide an ink furnishing apparatus which can efficiently remove water by separating from the ink the water admixed in the ink during a printing operation without providing any specific water separating mechanism and thus can effectively prevent a water content in the ink from increasing during the printing operation.

According to one aspect of the invention, an ink furnishing apparatus in a lithographic printing press for performing printing by furnishing a relatively high viscous ink and a dampening water to a printing plate on a plate cylinder is provided, and comprises:

a form roller contacting a peripheral surface of the printing plates, and rotating to displace the peripheral surface in a same direction and at a same peripheral speed as the peripheral surface of said printing plates;

a metering roller having a peripheral surface contacting the peripheral surface of the form roller directly or via at least one intermediate roller for matching rotation thereof with the form roller, the metering roller rotating to displace the peripheral surface thereof in the same direction as said rollers contacting thereto and in the same peripheral speed as the peripheral speed of the printing plates, and a large number of fine cavities formed on the peripheral surface for accommodating the ink;

a doctor means for contacting the peripheral surface of the metering roller;

an ink fountain positioned most upstream of an ink supply at a position below the doctor means having an opening upper portion and a front portion, and comprising side plates and a tilted base;

a fountain roller having a peripheral surface located at a position for blocking the front portion of the ink fountain, a position in the vicinity of the front edge of the base of the ink fountain via a first gap, and said peripheral surface thereof rotating to displace downwardly from the position for blocking the opening at the front portion of the ink fountain at a lower speed than that of the peripheral surface of the printing plates on the plate cylinder;

an even number of intermediate rollers provided between the fountain roller and the metering roller, amongst, a peripheral surface of a first intermediate roller located immediately downstream of the fountain roller being located in the vicinity of the peripheral surface of the fountain roller via said second gap smaller than the first gap, the peripheral surface of the first intermediate roller rotating to displace in the same direction to the displacement direction of the peripheral surface of the fountain roller and at the same peripheral speed to the peripheral surface of the printing plates on the plate cylinder, the peripheral surfaces of respective intermediate rollers including the first intermediate roller contacting sequentially to the peripheral surface of the metering roller, so as to rotate at the same direction and at the same peripheral speed to the peripheral surface of the printing plates on the plate cylinder;

a water receptacle vessel positioned downward from the route for furnishing the ink, whereby a first shearing force is exerted on the ink upon drawing out the ink deposited on the peripheral surface of the fountain roller through the first gap by rotation of the fountain roller, and a second shearing force is exerted on the ink due to a difference of peripheral speeds of the fountain roller and the first intermediate roller upon transition of the ink from the peripheral surface of the fountain roller to the peripheral surface of the first intermediate roller across the second gap, thus, water is separated from the ink, and the separated water is collected in the vessel.

In the preferred construction, a peripheral surface of the first intermediate roller may be an uneven surface roller having a uniformly arranged unevenness. The intermediate rollers may be an even number over four. Among the intermediate rollers, at least one of the odd number of intermediate rollers excluding the first intermediate roller from the upstream side may be an ink cylinder reciprocating in the axial direction over a given stroke.

BRIEF DESCRIPTION OF THE DRAWINGS

The present invention will be understood more fully from the detailed description given herebelow and from the accompanying drawings of the preferred embodiment of the invention, which, however, should not be taken to be limitative to the present invention, but are for explanation and understanding only.

In the drawings.

DESCRIPTION OF THE PREFERRED EMBODIMENT

The preferred embodiments of an ink furnishing apparatus according to the present invention will be discussed hereinafter in detail with reference to the accompanying drawings. In the following description, numerous specific details are set forth in order to provide a thorough understanding of the present invention. It will be obvious, however, to those skilled in the art that the present invention may be practiced without these specific details. In other instances, well known structures are not shown in detail in order to not unnecessarily obscure the description of the present invention.

Figure 1:
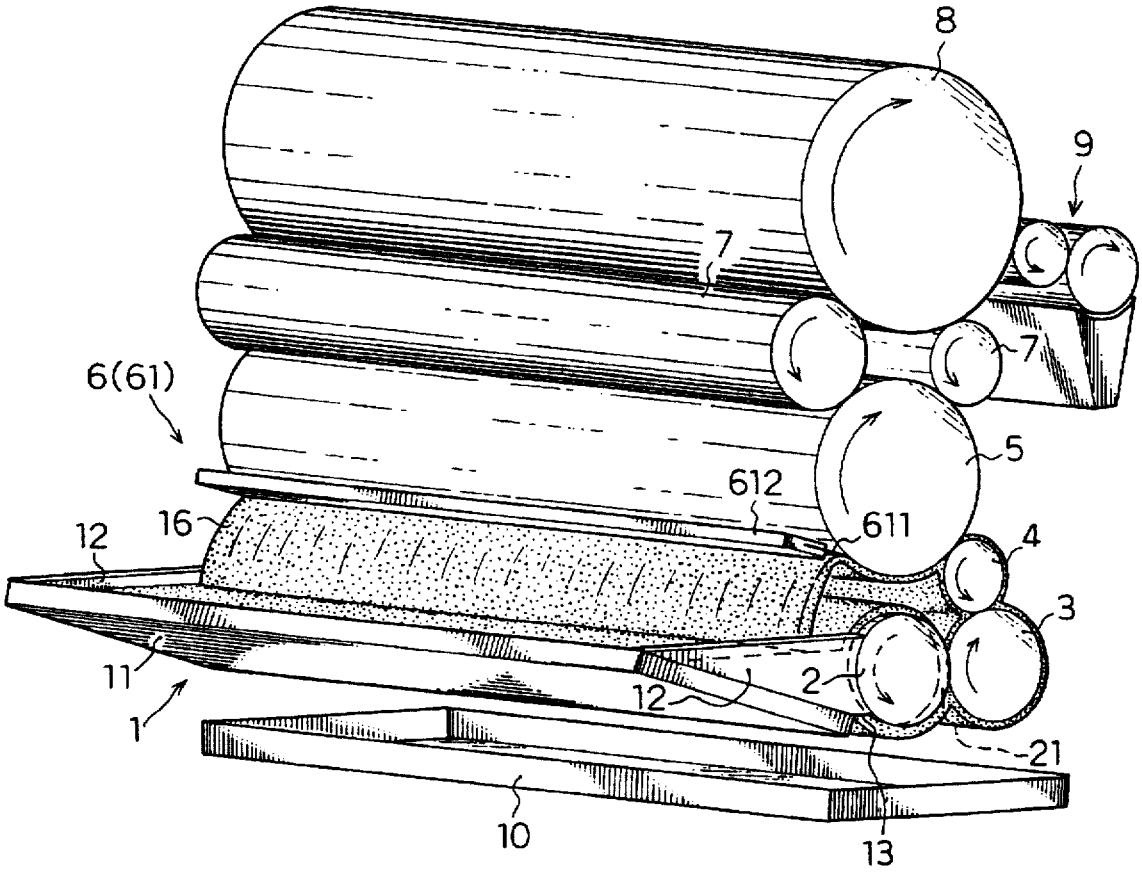
FIG. 1 is a perspective view showing one embodiment of an ink furnishing apparatus according to the present invention.

FIG. 1 is a perspective view showing general constructions of the preferred embodiments of ink furnishing apparatus according to the present invention. In FIG. 1, an ink fountain 1 is constructed with a base 11 descending toward the peripheral surface of a fountain roller 2 and side plates 12,12 partitioning both sides of a groove defined by the base 11 and the fountain roller 2. The ink fountain 1 is opened in the upper portion and stores an ink within the groove. Between the descending lower end of the base 11 and the peripheral surface of the fountain roller 2, a first gap 13 is provided. The ink in the first gap 13 is drawn by rotation of the fountain roller 2 by deposition on the peripheral surface thereof.

The opened front edge portion of the ink fountain 1 is blocked by the peripheral surface of the fountain roller 2 which defines the first gap 13 with the lower end of the tilted surface of the base 11.

The fountain roller 2 is driven to rotate in a direction that the peripheral surface thereof, blocking the opened front edge portion of the ink fountain, moves downwardly. The peripheral speed of rotation of the fountain roller 2 is variable depending upon the peripheral speed of a printing plate, but is less than the latter in the extent of 1/30 to 1/100, for example.

Between the fountain roller 2 and the metering roller 5 in ink furnishing, between zero and an even number of upstream side intermediate rollers are interposed. In the embodiment illustrated in FIGS. 8 to 10, no upstream side intermediate roller is employed. In the embodiment illustrated in FIGS. 1, 5 to 7 and 14, two upstream side intermediate rollers, namely, a first intermediate roller 3 and a second intermediate roller 4 are interposed. In the embodiment illustrated in FIGS. 11 to 13, four intermediate rollers, i.e. first, second, third and fourth intermediate rollers 3, 4, 41 and 42 are interposed.

Accordingly, the kind of roller to be arranged immediately downstream of the fountain roller 2 in ink furnishing is different in each embodiment.

Figure 8:
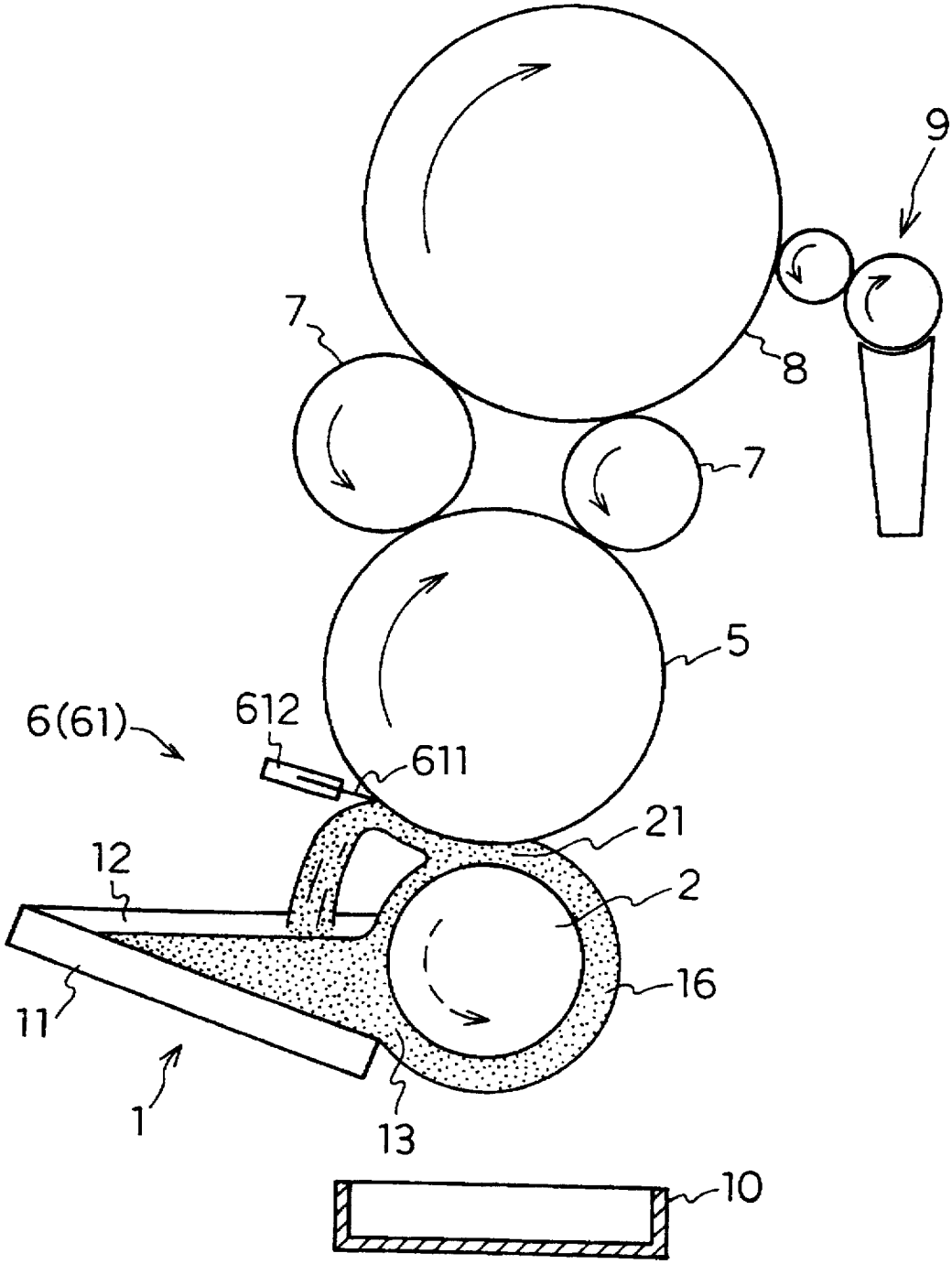
FIG. 8 is a sectional side elevation showing the preferred embodiment of the ink furnishing apparatus, in which the first and second intermediate rollers are removed in the embodiment of FIG. 5.
Figure 9:
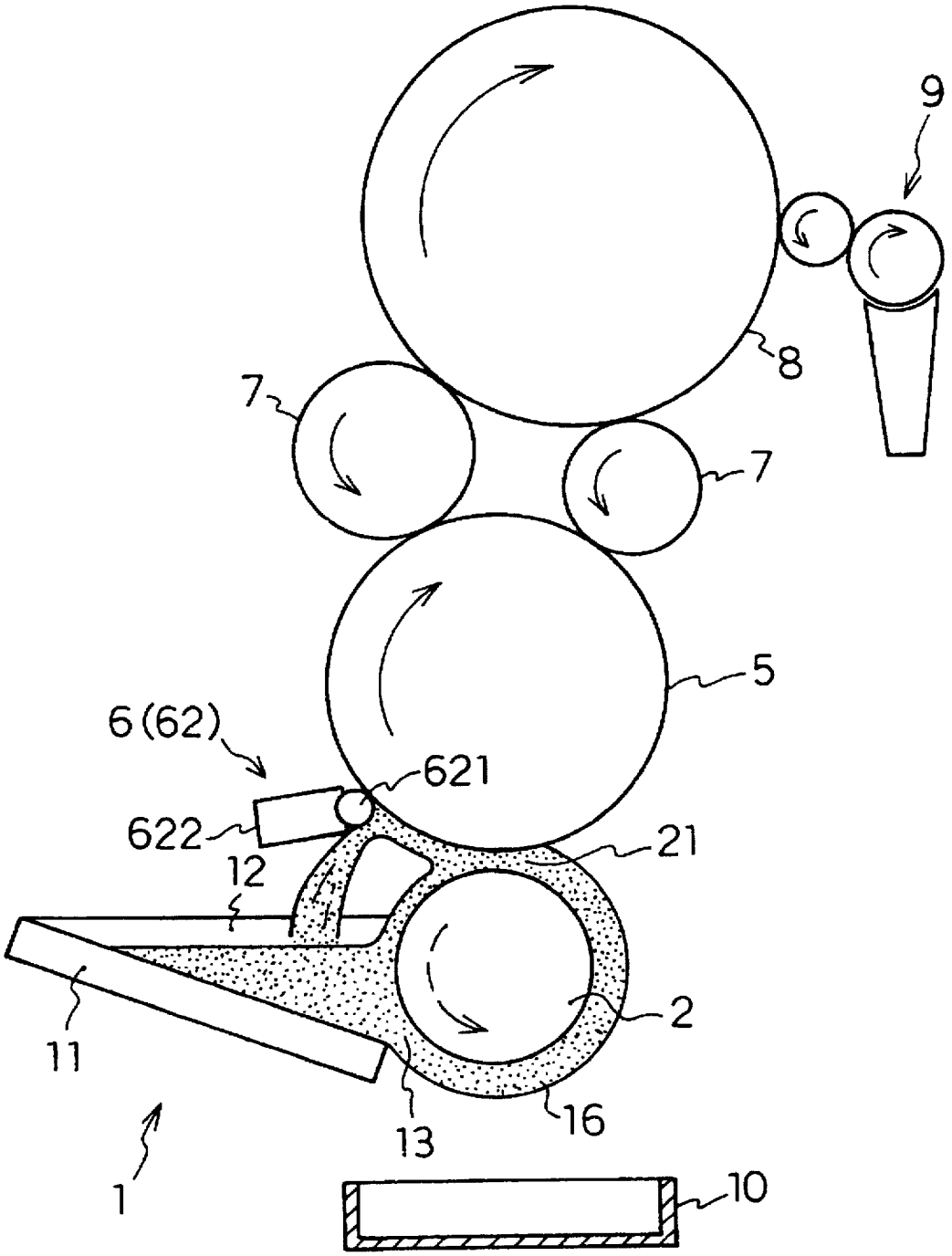
FIG. 9 is a sectional side elevation showing the preferred embodiment of the ink furnishing apparatus, in which the first and second intermediate rollers are removed in the embodiment of FIG. 6.
Figure 10:
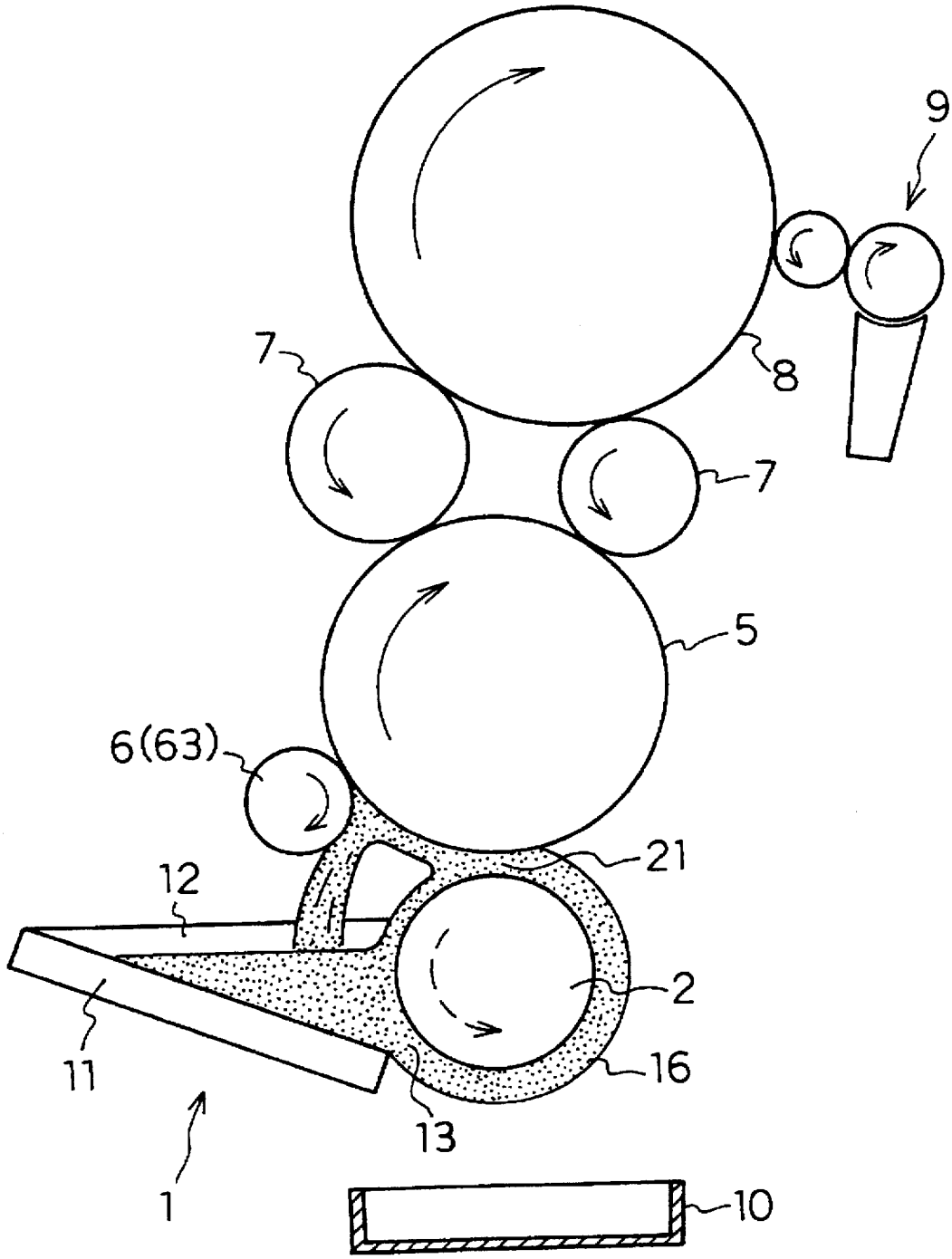
FIG. 10 is a sectional side elevation showing the preferred embodiment of the ink furnishing apparatus, in which the first and second intermediate rollers are removed in the embodiment of FIG. 7.

In the embodiment shown in FIG. 8 to 10, the peripheral surface of the metering roller 5 is located in the vicinity of the peripheral surface of the fountain roller 2 via a second gap 21 which is smaller than the first gap 13.

In contrast, in the embodiments illustrated in FIGS. 1, 5 to 7, 11 to 13 and 14, the peripheral surface of the first intermediate roller 3 is arranged in the vicinity of the peripheral surface of the fountain roller 2 via the second gap 21, which is smaller than the first gap 13.

Figure 4:
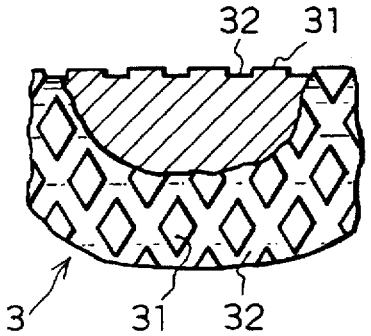
FIG. 4 is a partially sectioned enlarged view of a part of the peripheral surface of one embodiment of a first intermediate roller in the preferred embodiment of the ink furnishing apparatus according to the invention.

It is preferred that the first intermediate roller 3 is constructed as an uneven surface roller having a substantially uniformly distributed unevenness on the peripheral surface. In FIG. 4, on the peripheral surface of the first intermediate roller 3, a plurality of projections 31 separated by grooves 32 extending therearound are provided so as to facilitate reception of ink on the peripheral surface of the fountain roller 2. In conjunction therewith, the projections 31 and the grooves 32 provides difference of magnitude of depression force to be exerted on an ink layer passing through the gap between the fountain roller 2 and the uneven surface roller 3. The configuration of the projection 31 may be triangular, circular or so forth, other than a rhomboid shaped configuration as illustrated in FIG. 4. The projections 31 are arranged in a pitch of 0.5 to 5 mm. On the other hand, in place of regular unevenness as shown in FIG. 1, a satin form unevenness may be uniformly provided on the peripheral surface.

In the embodiment of FIGS., 1, 5 to 7, the second intermediate roller 4, the metering roller 5 and the form roller 7 are arranged in order with contacting peripheral surfaces, at the downstream side of the uneven surface roller 3 in ink furnishing. The peripheral surface of the form roller 7 is in contact with the printing plate on the plate cylinder 8. The uneven surface roller 3, the second intermediate roller 4, the metering roller 5 and the form roller 7 are driven to rotate at substantially the same peripheral speed as the plate cylinder.

On the other hand, the fountain roller 2, the first intermediate roller (uneven surface roller) 3, the second intermediate roller 4, the metering roller 5 and the form roller 7 are respectively displaced, the peripheral surface thereof in the same direction to the mating roller. The form roller 7 rotates in the same displacement direction and the same peripheral speed to the plate cylinder.

In the layout of the rollers as set forth above, during the ink transfer process wherein the ink is transferred from the uneven surface roller 3 to the second intermediate roller 4 and is supplied to the metering roller 5 at the downstream side, the ink is compressed and split twice. By repeated compression and splitting, the ink is temporarily softened and thus is temporarily provided with fluidity. Therefore, a good ink transfer condition can be established. It should be noted that the second intermediate roller 4 is a roller having a rubber surface layer with a surface hardness of 20 to 40 of Shore A.

Figure 11:
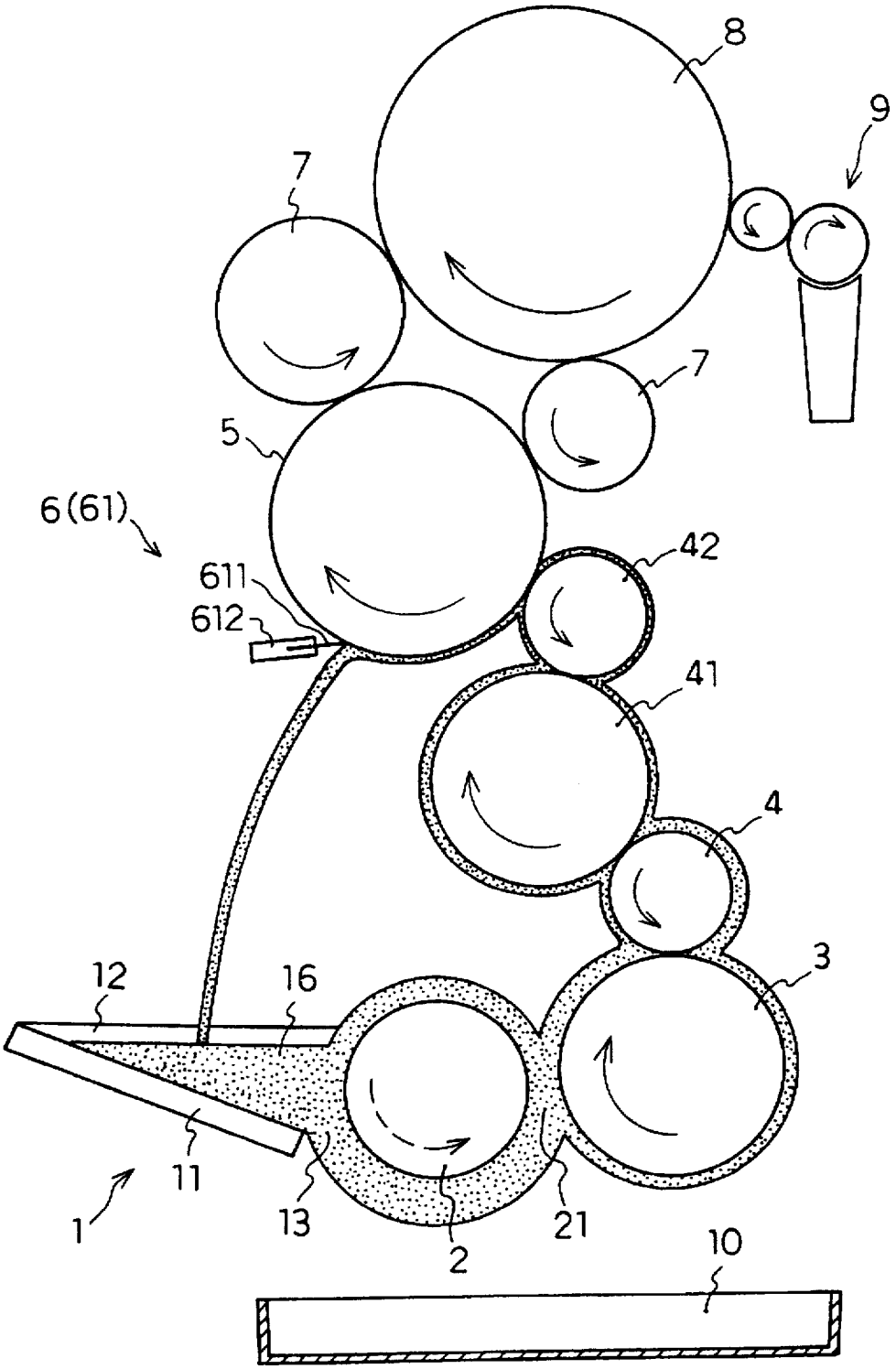
FIG. 11 is a sectional side elevation showing the preferred embodiment of the ink furnishing apparatus, in which third and fourth intermediate rollers are additionally provided in the embodiment of FIG. 5.
Figure 12:
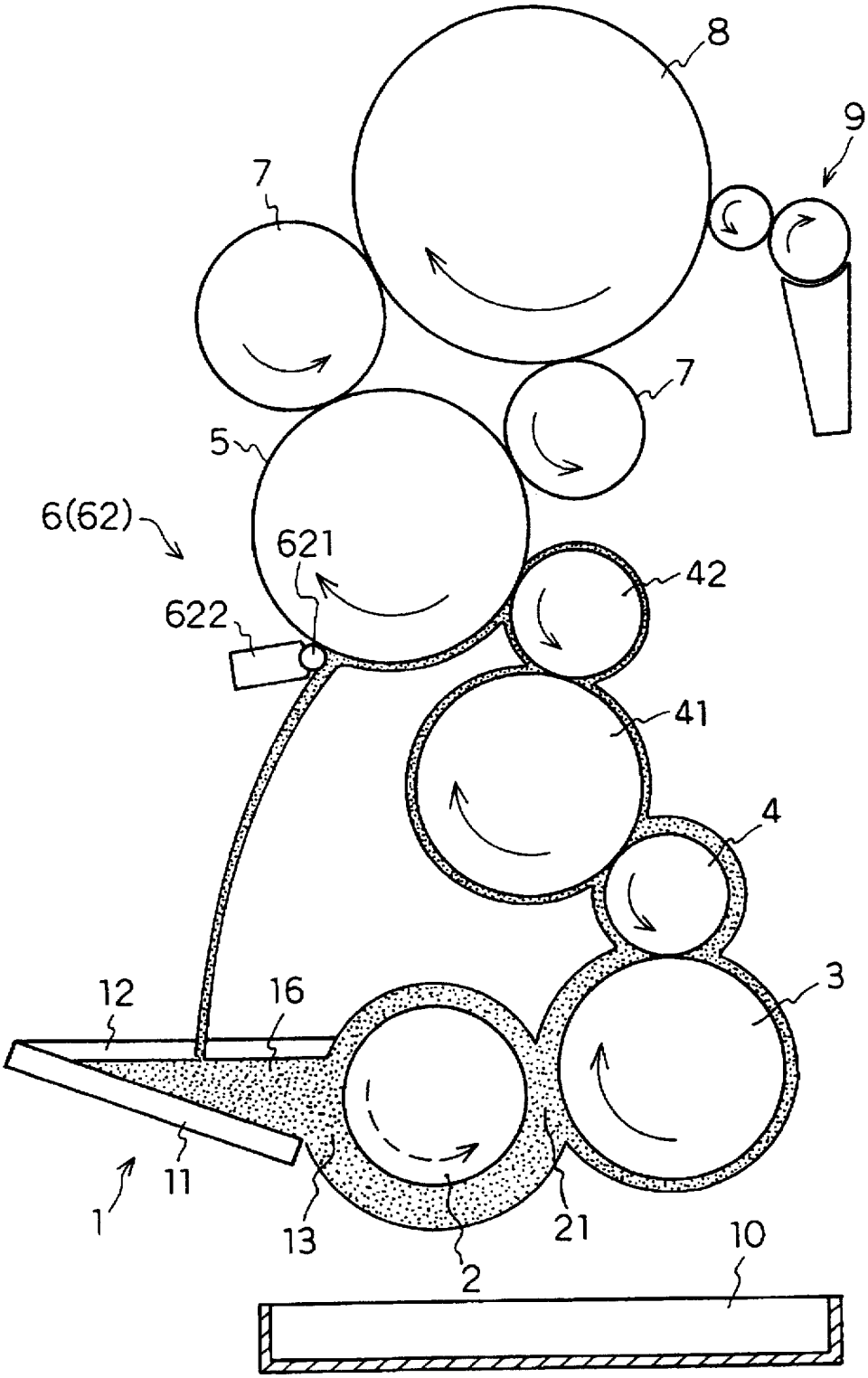
FIG. 12 is a sectional side elevation showing the preferred embodiment of the ink furnishing apparatus, in which third and fourth intermediate rollers are additionally provided in the embodiment of FIG. 6.
Figure 13:
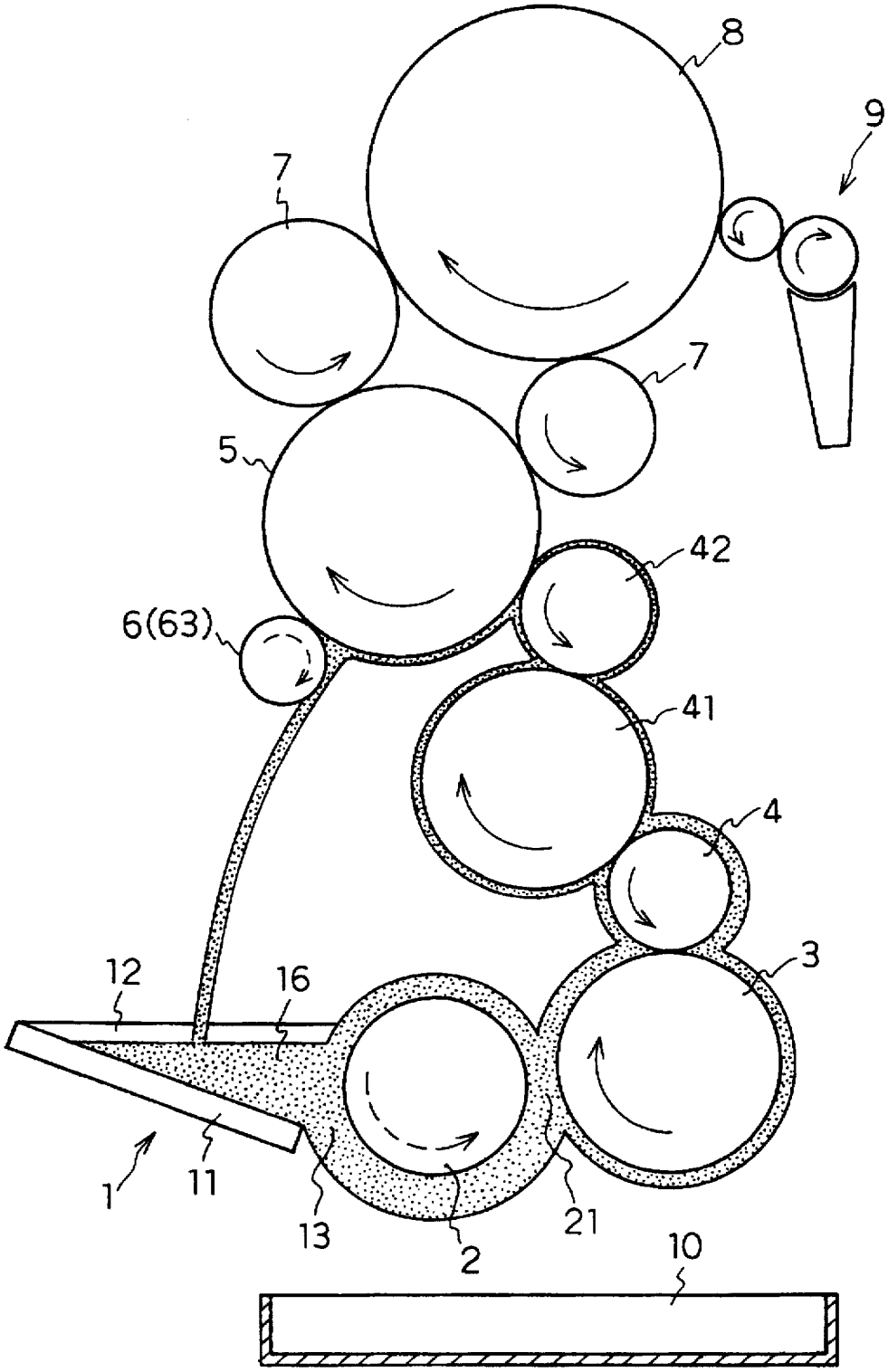
FIG. 13 is a sectional side elevation showing the preferred embodiment of the ink furnishing apparatus, in which third and fourth intermediate rollers are additionally provided in the embodiment of FIG. 7.

In the embodiment shown in FIGS. 11 to 13, which employs four upstream side intermediate rollers, a third intermediate roller 41 is a metallic cylinder contacting both the peripheral surface of the second intermediate roller 4 at the upstream side and the peripheral surface of a fourth intermediate roller 42 at the downstream side. The peripheral surface of the third intermediate roller 41 is coated with copper for attaining good wetting ability by the ink and for good ink transfer performance. The metallic third intermediate roller 41 is driven at a substantially equal peripheral speed relative to the uneven surface roller 3 as the upstream side first intermediate roller and in the same direction. The rotating direction of the third intermediate roller 41 is to cause displacement of the peripheral surface in the same direction to the peripheral surface of the second intermediate roller 4 located at immediately upstream, at the contact position therewith. Also, the rotating direction of the third intermediate roller 41 causes displacement of the peripheral surface in the same direction to the peripheral surface of the fourth intermediate roller 42 located at immediately downstream, at the contact position therewith.

The third intermediate roller 41 reciprocates in the axial direction thereof with a predetermined stroke in conjunction with rotation set forth above. At the axial end, the ink cylinder 41 cooperates with an oscillation mechanism (not shown) such as disclosed in Japanese Examined Patent Publication (Kokoku) No. Showa 57-15552, for example. The disclosure of the above-identified Japanese Examined Patent Publication No. Showa 57-15552 is herein incorporated by reference. The third intermediate roller 41 as cooperatively associated with the oscillation mechanism reciprocates in the axial direction by its own rotation. In practice, the reciprocating operation of the ink roller 41 is set in a stroke of 3 to 50 mm per 20 cycles of rotation thereof, for example.

The fourth intermediate roller 42 is a rubber roller having a rubber surface layer with a surface hardness of 20 to 40 of Shore A. The peripheral surface of the fourth intermediate roller 42 is located in contact with the peripheral surface of the third intermediate roller 41 and the metering roller 5. The peripheral surface of the fourth intermediate roller 42 not only rotates in the same direction and at the same speed of displacement as the peripheral surface of the third intermediate roller 41 at the position where the peripheral surface of the fourth intermediate roller 42 is in contact with the peripheral surface of the third intermediate roller 41, but also rotates in the same direction and at the same speed of displacement as the peripheral surface of the metering roller 5 at the position where the peripheral surface of the fourth intermediate roller 42 is in contact with the peripheral surface of the metering roller 5.

Figure 2:
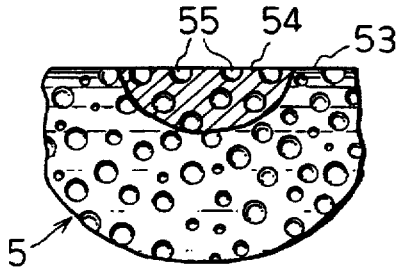
FIG. 2 is a partially sectioned enlarged view showing a part of the peripheral surface on one embodiment of a metering roller in the preferred embodiment of the ink furnishing apparatus according to the invention.

As shown in FIG. 2, a large number of fine ink receptacle cavities or recesses which may receive a predetermined amount of ink are uniformly distributed on the peripheral surface of the metering roller 5. The fine ink receptacle cavities are defined by fine voids 55 uniformly distributed in a matrix 54 forming an outer peripheral layer 53 of the metering roller 5. More specifically, the outer peripheral layer 53 of the metering roller 5 is formed by a material, in which fine hollow bodies called micro balloons of 5 to 300 μm in diameter are mixed with a synthetic resin matrix for uniform dispersion.

The metering roller 5 with uniformly dispersed fine voids 55 in the matrix 54 formed on the outer peripheral layer 53 will not cause significant or noticeable variation of the ink amount to be stored in the cavities on the peripheral surface of the metering roller 5 even when the peripheral surface of the metering roller 5 is worn by repeated ink scraping action of a doctor means 6 which will be discussed later, since the lost volume of the ink receptacle amount by wearing off of some fine voids can be compensated by the voids newly exposed to the peripheral surface.

The metering roller 5 having the outer peripheral layer formed by dispersing the fine void in the synthetic resin matrix is formed to have a Shore hardness in a range of 70 to 100 (Shore A).

Figure 3:
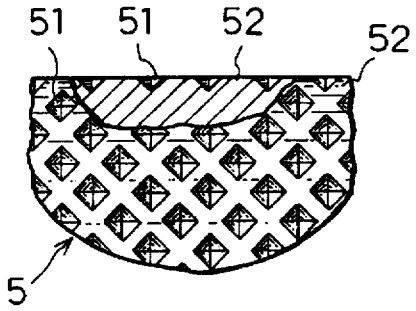
FIG. 3 is a partially sectioned enlarged view showing a part of the peripheral surface on another embodiment of a metering roller in the preferred embodiment of the ink furnishing apparatus according to the invention.

In the alternative, the metering roller 5 may also be formed to have a large number of regularly arranged recessed cells 51 and ridges 52 surrounding respective cells, as shown in FIG. 3. Such recessed cells 51 may be formed by rolling, laser dulling or corrosion on the surface of a material, such as metal, synthetic resin, tungsten carbide and so forth, in a density of 80 lines/cm to 200 lines/cm.

The doctor means 6 is located to contact the peripheral surface of the metering roller at a position downstream of the contact position with the second intermediate roller 4, in the rotating direction of the metering roller 5, and upstream of the contact position with the form roller 7. Specifically, the doctor means 6 may comprise a doctor blade 61 shown in FIG. 5, a doctor bar 62 shown in FIG. 6, and a doctor roller 63 shown in FIG. 7. All of these contact with the peripheral surface of the metering roller 5 over the entire length. By contact of these onto the metering roller 5, excess amount of ink on the peripheral surface of the metering roller 5 is scraped off.

Figure 5:
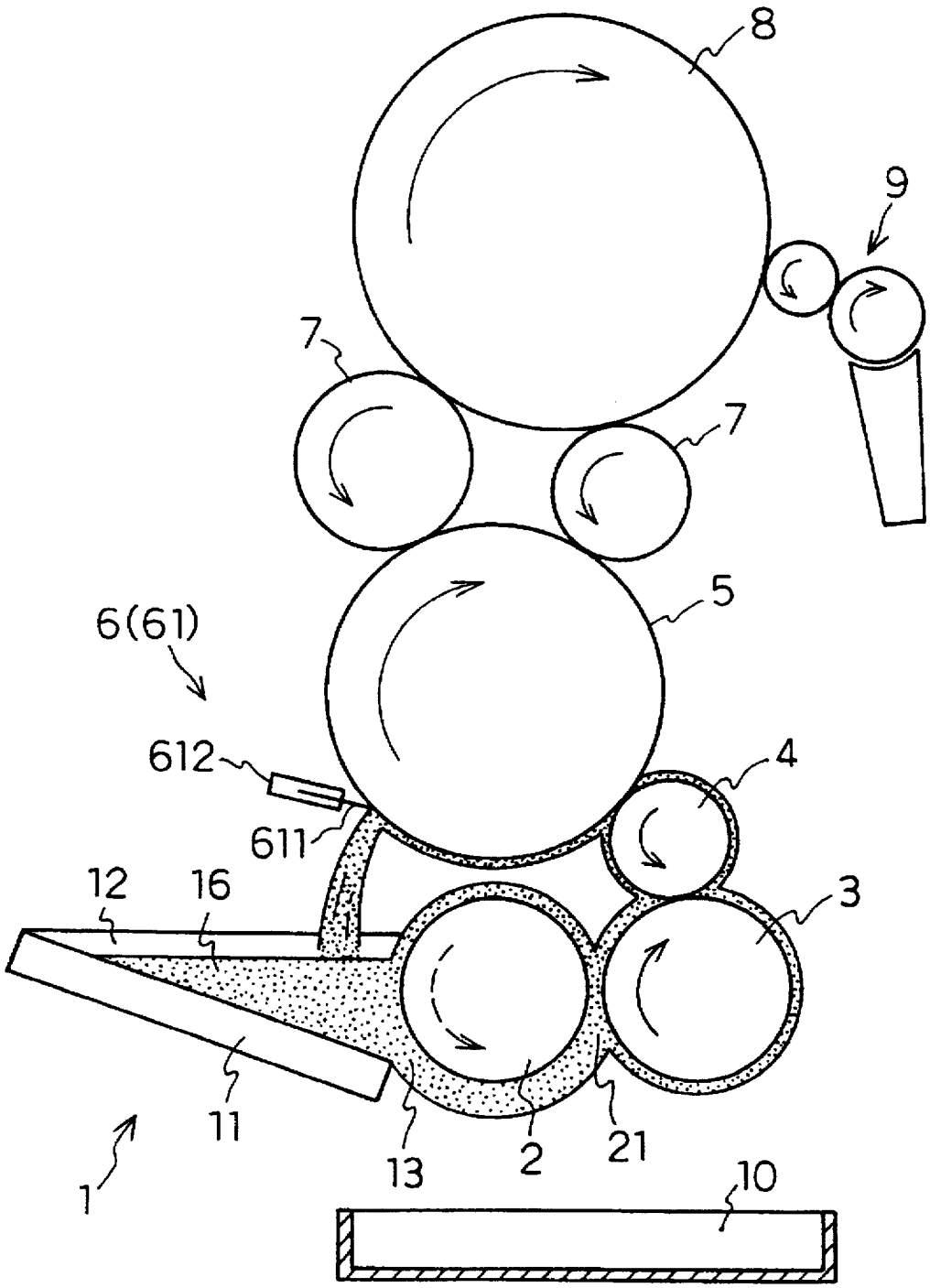
FIG. 5 is a side elevation of the preferred embodiment of the ink furnishing apparatus, illustrating one embodiment of a doctor means constituted of a doctor blade, in the embodiment of FIG. 1.

In FIG. 5, the doctor blade 61 includes a blade 611 contacting the peripheral surface of the metering roller 5 and a blade holder 612 supporting the blade 611. The doctor blade 61 is supported on a frame (not shown).

Figure 6:
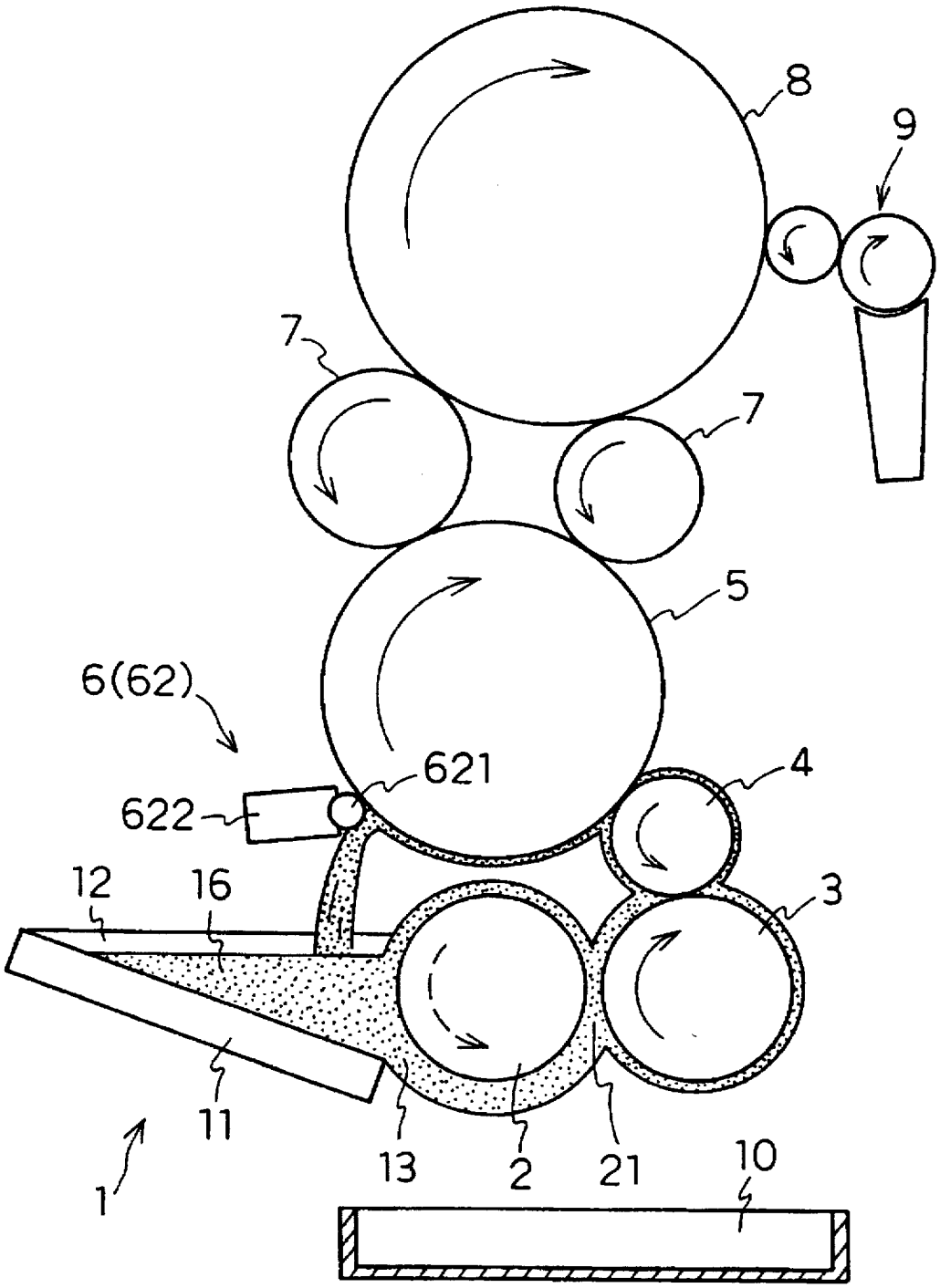
FIG. 6 is a side elevation of the preferred embodiment of the ink furnishing apparatus, illustrating one embodiment of a doctor means constituted of a doctor bar, in the embodiment of FIG. 5.

In FIG. 6, the doctor bar 62 comprises a bar 621 contacting the peripheral surface of the metering roller 5 and a back-up stay 622 restricting deflecting deformation of the bar. The doctor bar 62 is supported on a frame (not shown).

Figure 7:
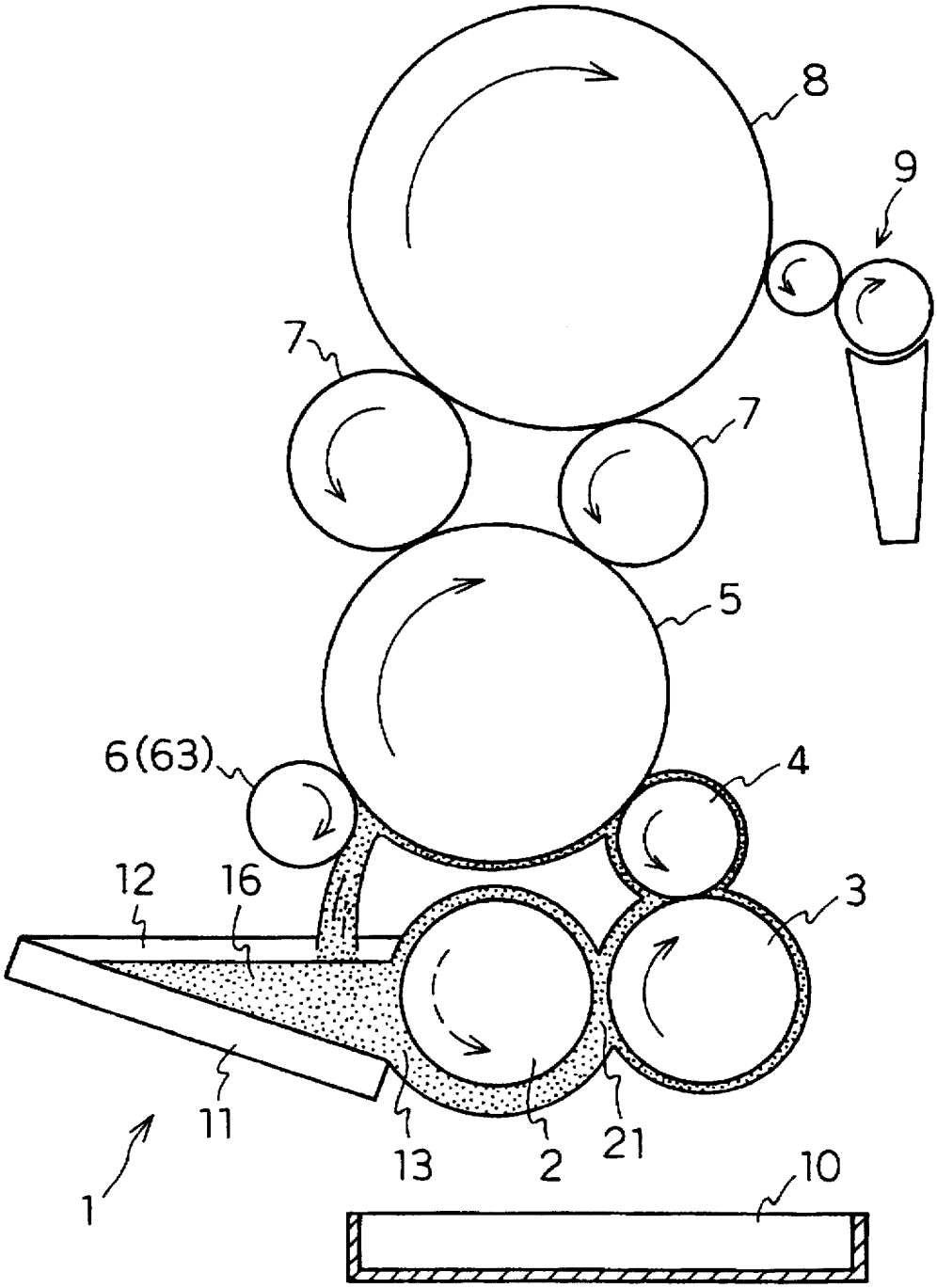
FIG. 7 is a side elevation of the preferred embodiment of the ink furnishing apparatus, illustrating one embodiment of a doctor means constituted of a doctor roller.

In FIG. 7, the doctor roller 63 contacts with the peripheral surface of the metering roller 5. The doctor roller 63 is supported on a frame (not shown).

The doctor roller 63 is designed to employ various drive mechanisms listed hereinafter, corresponding to various printing modes. Namely, as shown in FIG. 12, the doctor roller 63 is provided with a drive mechanism (not shown) which drives the doctor roller 63 to rotate to cause displacement of the peripheral surface in a direction opposite to the direction of displacement of the metering roller 5 at the contacting position, irrespective of the peripheral speed. It should be noted that the doctor roller may be provided with the drive mechanism which can rotate the doctor roller 63 at a peripheral speed lower than the peripheral speed of the metering roller 5 as well as the peripheral surface of the doctor roller 63 being displaced in the same direction to displacement of the peripheral surface of the metering roller 5, at the contact portion therebetween. The material and hardness of the portion of the doctor means 6 contacting with the peripheral surface of the metering roller 5 are selected depending upon the material and hardness of the peripheral surface of the metering roller for minimizing wearing while maintaining desired ink scraping performance.

The form roller 7 is supplied the ink substantially uniformly over the entire length from the peripheral surface of the metering roller 5 scraped off the excess amount of ink. Then, the ink is furnished on the printing plate on the plate cylinder 8 from the form roller 7. It should be noted that the form roller is a roller having a rubber surface layer having a surface hardness of 20 to 40 (Shore A). The peripheral surface of the form roller 7 is in contact with the printing plate. At the contact position, the peripheral surface of the form roller is displaced in the same direction as the direction of displacement of the printing plate and rotates at the same peripheral speed as the printing plate.

Figure 14:
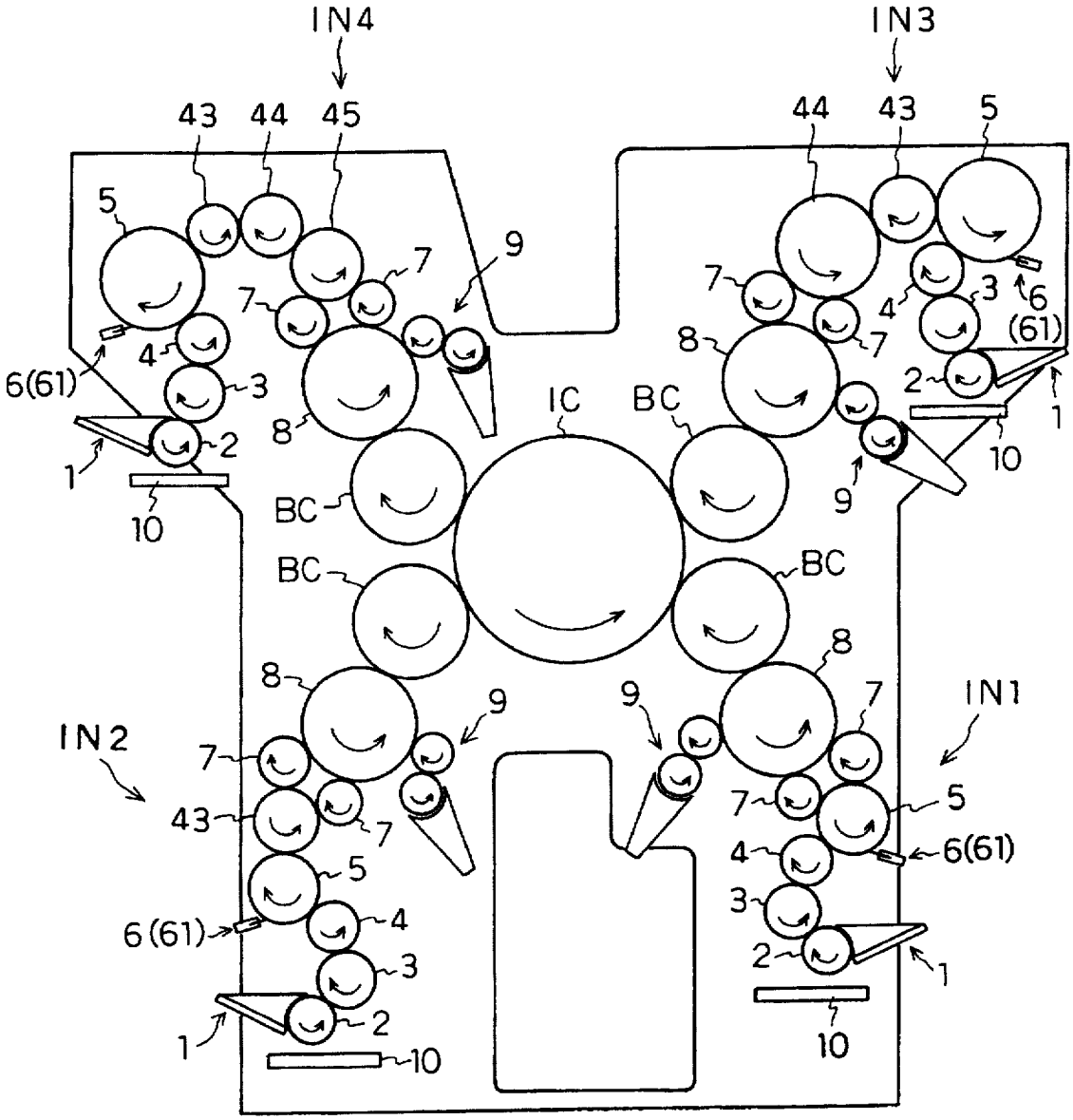
FIG. 14 is a general partly sectioned view of a satellite type offset printing press, in which ink furnishing apparatus of the embodiment of FIG. 5 are arranged radially with respect to a common impression cylinder, in the four sets of ink furnishing apparatus, zero to three of downstream side intermediate rollers are appropriately provided between a metering roller and a form roller due to difference of mounting direction and mounting height with respect to the common impression cylinder.

In the embodiment shown in FIGS. 1, 5 to 13, the form roller 7 is located immediately downstream of the metering roller 5. In contrast to this, in FIG. 14, a satellite type offset printing press is provided, for the arrangement where four sets of ink furnishing apparatus IN1, IN2, IN3 and IN4 are arranged radially via the plate cylinder 8 and a blanket cylinder BC, toward a common impression cylinder IC which is located at the central position. Each ink furnishing apparatus is required to have the same rotating direction not withstanding any difference in the mounting direction and the mounting position. For this purpose, zero to three downstream side intermediate rollers, namely a fifth roller 43, a sixth intermediate roller 44 and a seventh intermediate roller 45 are interposed between the metering roller 5 and the form roller 7. The relationship of these downstream side intermediate rollers 43, 44 and 45 is illustrated in FIG. 14. The direct coupling type between the metering roller 5 and the form roller 7 is only ink furnishing apparatus IN1 at the right lower portion in FIG. 14. Remaining three ink supply apparatus are interposed downstream from the intermediate rollers, between the metering roller 5 and the form roller 7. Namely, in the ink furnishing apparatus IN2 at the left lower portion, the fifth intermediate roller 43 is interposed. Similarly, in the ink furnishing apparatus IN3, the fifth and sixth intermediate rollers 43 and 44 are interposed. On the other hand, in the ink furnishing apparatus IN4 located at the left upper portion, the fifth, sixth and seventh intermediate rollers 43, 44 and 45 are interposed. Thus, the ink is transferred from the metering roller 5 to the form roller 7 via the intermediate rollers.

On the other hand, a peripheral surface of a roller for supplying a dampening water in a dampening water-supplying apparatus 9 contacts with the surface of the printing plates on the plate cylinder 8, upstream in the rotating direction from the position where the form roller 7 contacts with the surface of the printing plates on the plate cylinder 8. Thus, the dampening water is supplied to the surface of the printing plates via the contact position therebetween.

On the other hand, the dampening water supplied to the printing plate serves to avoid depositing ink on a non-image printing portion of the printing plate, However, supply of the dampening water to the printing plate surface is not limited to the non-image printing portion and generally supplied to the overall surface of the printing plate. Therefore, an extra amount of water is supplied. The extra water flows back through each intermediate roller to the ink 16 in the ink fountain 1, and causes a problem in the printing density. The phenomenon of the surge flow of the extra water is characteristic in a keyless type ink furnishing apparatus which reduces the number of rollers. This is true even where relatively high viscous ink is employed.

In the present invention, in order to remove the excessive dampening water from the ink, a space between the position on the peripheral surface of the fountain roller 2 corresponding to the first gap 13 and at least the position on the roller located immediately downstream of the fountain roller corresponding to the second gap 21 defined therebetween, is opened downwardly. In the embodiment of FIGS. 1, 5 to 7 and 11 to 13, the roller located at the immediate downstream side of the fountain roller is the uneven surface roller 3, and in the embodiment of FIGS. 8 to 10, the roller located at the immediate downstream side of the fountain roller is the metering roller. At the position opposing to the opened space, a water receptacle means including an upper end opened vessel 10 is provided.

In the embodiment set forth above, discussion will be given hereinafter with respect to separation of the dampening water admixed in the ink and the removal thereof.

At first, when the high viscous ink 16 is filled in the ink fountain 1, since such ink 16 has low fluidity, the ink can be maintained in the ink fountain 1 without causing drooping off through the first gap 13 between the bottom edge of the ink fountain 1 and the peripheral surface of the fountain roller 2.

At this condition, when the fountain roller 2 is driven to rotate while displacing the peripheral surface of the fountain roller downwardly. Then, the ink 16 deposited on the peripheral surface of the fountain roller 2 is drawn by the rotation of the fountain roller 2. Then, the thickness of the ink is adjusted to be a thickness permitting passing through the first gap 13.

By scraping of the front edge of the ink fountain 1, the first shearing force is applied to the ink 16. When the water is admixed in the ink 16, stable condition is destroyed by the shearing force, to cause a part of the water to separate from the ink. Then, by further application of the shearing force, the ink becomes quite unstable causing variation of the admixing condition.

The ink 16 to which is applied the first shearing force is drawn out of the ink fountain and deposited on the peripheral surface of the fountain roller 2. Then, the ink 16 is carried on the peripheral surface of the fountain roller 2 to be transferred to the second gap 21 defined between the fountain roller 2 and the first intermediate roller, such as the uneven surface roller 3 (herein after discussion will be given with the assumption that the roller contacting the peripheral surface of the fountain roller is the uneven surface roller). As set forth above, the second gap 21 is narrower than the first gap 13. The uneven surface roller 3 is driven to rotate at a higher peripheral speed than that of the fountain roller and in the same direction. Thus, the ink 16 carried on the peripheral surface of the fountain roller 2 reaches the second gap 21. Then, due to difference of the peripheral speeds between the fountain roller 2 and the uneven surface roller 3, a second shearing force is applied to the ink.

The ink 16 to which is exerted the second shearing force is successfully separated from the water. In addition, the ink 16 to be subject the shearing force, is relatively thick, therefore the amount of the water separated from the ink 16 becomes relatively large. The separated water is aggregated with high fluidity to be easily grown to drop into the vessel 10.

Furthermore, by employing the uneven surface roller 3 as the first intermediate roller adjacent the fountain roller 2, the depression force to be exerted on the ink 16 passing through the second gap 21 can be locally varied. Therefore, the water having higher fluidity than the ink is easily concentrated locally to grow into the greater size quickly to make removal of the separated water efficient.

In the embodiment shown in FIGS. 8 to 10, the metering roller is located adjacent the fountain roller 2 across the second gap 21. Since there is a slight difference of the peripheral speeds between the fountain roller 2 and the metering roller 5, the second shearing force is exerted to the ink 16 similarly to that set forth above to enable separation of the water from the ink.

The ink 16 reaching the second gap 21 is supplied to the metering roller 5 via the peripheral surfaces of the uneven surface roller 3 and the second intermediate roller 4, in the embodiment shown in FIGS. 1, 5 to 7. On the other hand, in the embodiment of FIGS. 8 to 10, the ink 16 is directly transferred to the metering roller 5 from the fountain roller 2. Also, in the case of the embodiment of FIGS. 11 to 13, the ink 16 is transferred to the metering roller 5 via the peripheral surfaces of the uneven surface roller 3, the second intermediate roller 4, the third intermediate roller 41 and the fourth intermediate roller 42.

The ink 16 supplied to the peripheral surface of the metering roller 5 reaches the contact position of the doctor means 6. Then, the excessive ink 16 is scraped off the metering roller 5 by the doctor means 6. The scraped ink 16 is collected in the ink fountain provided with an opening the upper end.

The ink 16 within the recesses formed on the peripheral surface of the metering roller 5, from which the excessive ink is scraped off reaches the form roller 7 by rotation of the metering roller to be transferred thereto. The ink supplied to the peripheral surface of the form roller 7 reaches the contact position with the press plate surface to be transferred to the surface of the priming plate on the plate cylinder 8.

On the peripheral surface of the form roller 7 contacted to the printing plate, the dampening water is transferred from the non-image printing portion. The water is scraped off together with the ink 16 and drops into the ink fountain 1.

The ink 16 collected in the ink fountain 1 is again drawn through the first gap 13 by rotation of the peripheral surface of the fountain roller. The water content in the ink 16 is separated from the ink 16 through the exertion of two shearing forces on the ink 16 and is collected in the vessel 10. Accordingly, on the periphery of the metering roller 5, high purity ink 16 containing a lesser content of water can be supplied constantly.

The present invention includes an embodiment having a mechanism (not shown) for varying the size of the first gap 13.

FIG. 14 shows an embodiment of a satellite type offset printing press, in which four ink furnishing apparatus IN1, IN2, IN3 and IN4 according to the present invention are provided in radial arrangement with respect to the common impression cylinder IC. Each ink furnishing apparatus is constructed to contact the impression cylinder IC via the plate cylinder 8 and the blanket cylinder BC. For the necessity of matching the rotating direction beyond the mounting direction and the mounting position of respective ink furnishing apparatus, zero to three downstream side intermediate rollers 43, 44 and 45 are incorporated. Other construction is the same as those of the foregoing embodiments.

As set forth above, the ink furnishing apparatus according to the present invention can solve the problems caused in the lithographic printing press in the keyless ink furnishing system which is adapted to apply a relatively high viscous ink. Particularly, according to the present invention, the problem of penetration of the dampening water supplied to the non-image printing portion on the printing plate surface of the plate cylinder into the ink furnishing apparatus to cause lowering of the printing quality due to dispersion of the water in the ink, can be solved. Namely, by utilizing the construction for improving the ability to deposit the ink into the recesses of the metering roller by temporarily providing fluidity to relatively high viscous ink by exerting a shearing force through a first gap between the ink fountain and the fountain roller and a second gap between the fountain roller and the roller immediately downstream of the fountain roller where the second gap is smaller than the first, the water in the high viscous ink can be effectively and efficiently separated and removed from the ink.

Accordingly, even when a printing operation is continued for a long period, the water content in the ink will never be increased. Therefore, degradation of the printing quality due to presence of an increased amount of water in the ink will never be caused.

Particularly, according to the present invention, since strong stirring by suction and pressure feeding of the ink in the ink fountain which is not performed, and instead two shearing forces are exerted against a relatively thick ink layer, large amount of water can be efficiently separated and removed from the ink.

Furthermore, in the present invention, the first intermediate roller has an uneven surface, so the water separated from the ink may be concentrated in the recesses of the uneven surface when the second shearing force is exerted. Accordingly, the water is promoted to drop, whereby, the water may be rapidly removed from the ink, so that the keyless printing press can be operated under high speed.

Although the invention has been illustrated and described with respect to exemplary embodiments thereof, it should be understood by those skilled in the art that the foregoing and various other changes, omissions and additions may be made therein and thereto, without departing from the spirit and scope of the present invention. Therefore, the present invention should not be understood as being limited to the specific embodiments set out above but to include all possible embodiments which can be embodied within a scope of the appended claims and any equivalents thereof.

What is claimed is:

1. An ink furnishing apparatus in a lithographic printing press for performing printing by furnishing relatively high viscous ink and a dampening water on printing plates on a plate cylinder, comprising:

a form roller contacting a peripheral surface of said printing plates, and rotating to displace the peripheral surface thereof in the same direction and at the same peripheral speed as the peripheral surface of said printing plates thereof;

a metering roller having a peripheral surface contacting with the peripheral surface of said form roller directly or via at least one downstream intermediate roller for matching rotation thereof with the form roller, and a large number of fine cavities being formed on the peripheral surface thereof for accumulating the ink, said metering roller rotating to displace the peripheral surface thereof in the same direction as any rollers contacting thereto, and in the same peripheral speed as the peripheral surface of the printing plates;

a doctor means for contacting with the peripheral surface of said metering roller;

an ink fountain positioned at the most upstream side in a route for furnishing the ink, said ink fountain comprising an opening at an upper portion thereof, an opening at a front portion thereof, side plates and a tilted base plate;

a fountain roller having a peripheral surface thereof located at a position for blocking the opening at the front portion of said ink fountain, and at a position in the vicinity of a front edge of said base plate of said ink fountain via a first gap, said peripheral surface thereof rotating to displace downwardly from the position for blocking the opening at the front portion of said ink fountain at a lower speed than that of the peripheral surface of the printing plates of said plate cylinder; and an even number of upstream intermediate rollers provided between said fountain roller and said metering roller, amongst, a peripheral surface of a first intermediate roller located immediate downstream of said fountain roller being located in the vicinity of the peripheral surface of said fountain roller via a second gap smaller than said first gap, the peripheral surface of said first intermediate roller rotating to displace in the same direction to that of the peripheral surface of said fountain roller and at the same peripheral speed to the peripheral surface of said printing plates on said plate cylinder, the peripheral surfaces of respective upstream intermediate rollers including said first intermediate roller contacting sequentially to the peripheral surface of said metering roller, so as to rotate at the same direction and at the same peripheral speed to the peripheral surface of said printing plates on said plate cylinder; and a water receptacle vessel positioned downward from the route for furnishing the ink, whereby, a first shearing force is exerted on said ink upon drawing out the ink deposited on the peripheral surface of said fountain roller through said first gap by rotation of said fountain roller, and a second shearing force is exerted on said ink due to difference of peripheral speeds of said fountain roller and said first intermediate roller upon transition of the ink from the peripheral surface of said fountain roller to the peripheral surface of said first intermediate roller across said second gap, thus water being separated from said ink, and the separated water being collected in said vessel.

2. An ink furnishing apparatus as set forth in claim 1, wherein the peripheral surface of said first intermediate roller has a uniform uneven surface.

3. An ink furnishing apparatus as set forth in claim 1, wherein said upstream intermediate rollers are in even number.

4. An ink furnishing apparatus as set forth in claim 3, wherein, among said upstream intermediate rollers, at least one of the odd number of intermediate rollers excluding the first intermediate roller from the upstream side is a reciprocating ink cylinder reciprocating in the axial direction over a given stroke.

* * * * *